US009217273B2

(12) United States Patent
Floersch et al.

(10) Patent No.: US 9,217,273 B2
(45) Date of Patent: Dec. 22, 2015

(54) APPARATUS FOR RESTRICTING ACCESS TO A RETAIL STORE AISLE

(71) Applicant: Target Brands, Inc., Minneapolis, MN (US)

(72) Inventors: David J. Floersch, Minneapolis, MN (US); Jennifer A. Theisen, Crystal, MN (US); Alex K. Poniatowski, Brooklyn Park, MN (US); Richard A. Sherwood, Southlake, TX (US)

(73) Assignee: Target Brands, Inc., Minneapolis, MN (US)

( * ) Notice: Subject to any disclaimer, the term of this patent is extended or adjusted under 35 U.S.C. 154(b) by 138 days.

(21) Appl. No.: 14/149,034

(22) Filed: Jan. 7, 2014

(65) Prior Publication Data

US 2015/0190001 A1 Jul. 9, 2015

(51) Int. Cl.

| | |
|---|---|
| ***E06B 3/46*** | (2006.01) |
| ***E06B 1/00*** | (2006.01) |
| ***E06B 5/00*** | (2006.01) |
| *A47F 10/02* | (2006.01) |

(52) U.S. Cl.

CPC ..... *E06B 1/003* (2013.01); *E06B 5/006* (2013.01); *A47F 10/02* (2013.01); *E06B 3/4654* (2013.01)

(58) Field of Classification Search

USPC ..... 211/180; 160/37

IPC .. E06B 11/02,11/06, 5/006, 3/4654; A47F 5/00

See application file for complete search history.

(56) References Cited

U.S. PATENT DOCUMENTS

| | | | | |
|---|---|---|---|---|
| 1,750,989 | A | | 3/1930 | Bradfield |
| 1,822,729 | A | * | 9/1931 | Fairhurst ..... 160/33 |
| 1,882,331 | A | | 10/1932 | Martinek |
| 2,798,246 | A | | 7/1957 | Holloway |
| 3,500,894 | A | * | 3/1970 | Pofferi ..... 160/22 |
| 3,599,702 | A | | 8/1971 | Bedard |
| 3,830,374 | A | * | 8/1974 | Kassimir ..... 211/1 |
| 3,971,477 | A | * | 7/1976 | Bruderly et al. ..... 211/189 |
| 4,046,083 | A | * | 9/1977 | Murdoch et al. ..... 108/107 |
| 4,368,804 | A | * | 1/1983 | Cole ..... 186/57 |
| 4,574,863 | A | * | 3/1986 | Coleman et al. ..... 160/216 |
| 4,658,878 | A | | 4/1987 | Williams |
| 4,865,110 | A | | 9/1989 | Seal |
| 5,025,846 | A | | 6/1991 | West |

(Continued)

FOREIGN PATENT DOCUMENTS

EP 2636838 A1 9/2013

OTHER PUBLICATIONS

Office Action from Canadian Patent Application No. 2,844,872, mailed Oct. 31, 2014 (3 pages).

(Continued)

*Primary Examiner* — David Purol

(74) *Attorney, Agent, or Firm* — Leanne Taveggia Farrell; Westman, Champlin & Koehler, P.A.

(57) ABSTRACT

An apparatus includes a first retail display unit for supporting one or more retail products and a pocket mounted to a side of the first retail display unit. The pocket has a hollow interior and an open end. A gate has a fixed end coupled to the hollow interior of the pocket and a lockable end. The fixed and lockable ends of the gate are located within the hollow interior of the pocket when the gate is in storage and the lockable end of the gate is extended through the at least one open end of the pocket and away from the first retail display unit when the gate is moved into use.

19 Claims, 19 Drawing Sheets

(56) References Cited

U.S. PATENT DOCUMENTS

| | | | | |
|---|---|---|---|---|
| 5,117,585 | A | 6/1992 | Andrisin, III | |
| 5,295,527 | A | 3/1994 | West | |
| 5,361,538 | A | 11/1994 | McNabb | |
| 5,732,834 | A * | 3/1998 | Wells | 211/162 |
| 6,119,754 | A * | 9/2000 | Okonsky | 160/10 |
| 6,135,423 | A * | 10/2000 | Johnson | 256/1 |
| 6,193,083 | B1 * | 2/2001 | Wood | 211/87.01 |
| 6,202,729 | B1 | 3/2001 | Cunningham | |
| 6,250,016 | B1 | 6/2001 | Gravel | |
| 6,427,857 | B1 * | 8/2002 | Adams et al. | 211/189 |
| 6,470,952 | B1 | 10/2002 | Cline et al. | |
| 6,688,480 | B1 | 2/2004 | Denny | |
| 7,699,089 | B2 | 4/2010 | Knutson et al. | |
| 7,845,384 | B2 | 12/2010 | Goodman et al. | |
| 7,926,538 | B2 | 4/2011 | Coleman et al. | |
| 8,079,179 | B2 | 12/2011 | Lemming | |
| 8,087,443 | B2 | 1/2012 | Snyder et al. | |
| 8,479,798 | B2 | 7/2013 | Goodman | |
| 2004/0173785 | A1 | 9/2004 | Russo | |
| 2005/0098770 | A1 * | 5/2005 | Schell | 256/25 |
| 2005/0279464 | A1 * | 12/2005 | O'Brien | 160/354 |
| 2009/0044450 | A1 | 2/2009 | Hallman | |
| 2009/0096572 | A1 | 4/2009 | Bosik et al. | |

OTHER PUBLICATIONS

Office Action from Canadian Patent Application No. 2,844,872, mailed Jun. 27, 2014 (2 pages).

* cited by examiner

APPARATUS FOR RESTRICTING ACCESS TO A RETAIL STORE AISLE

BACKGROUND

Retail stores are often arranged by department or category. Within each department or category are aisles that provide access to items displayed on opposing rows of gondola shelves. In some instances, aisles need to be blocked or closed relative to the rest of the store because of the type of product that the gondola shelves in that particular aisle support. For example, a pharmacy department or a liquor department may need to restrict access to products in their category and therefore may need to block or close certain aisles.

The discussion above is merely provided for general background information and is not intended to be used as an aid in determining the scope of the claimed subject matter.

SUMMARY

An apparatus for restricting access to an aisle in a retail store includes a first retail display unit for supporting one or more retail products and a pocket mounted to a side of the first retail display unit. The pocket has a hollow interior and an open end. A gate has a fixed end coupled to the hollow interior of the pocket and a lockable end. The fixed and lockable ends of the gate are located within the hollow interior of the pocket when the gate is in storage and the lockable end of the gate is extended through the at least one open end of the pocket and away from the first retail display unit when the gate is moved into use.

The first retail display unit is a gondola fixture that includes at least two base ends, at least one base deck supported by the at least two base ends, at least two upright frame members extending from the at least one base deck and at least one upright panel located between the at least two upright frames. The second display unit is a gondola end fixture that includes a base having a back, an end deck supported by the base, two upright frame members extending from the end deck and a back panel located between the two upright frame members of the second display unit.

To restrict access to the aisle in the retail store the gate, which is entirely stored in the pocket in a storage state, is moved so that the lockable end of the gate passes through the open end of the pocket and across the aisle that is defined at least in part by the first retail display unit and the second retail display unit.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION OF DRAWINGS

DETAILED DESCRIPTION

Described below is an apparatus for restricting access to certain products, departments or categories of an aisle in a retail store. Components of the apparatus are used with standard aisle-type gondola display systems so as to lock up, as needed, entire aisles or portions of aisles during retail store hours or after retail store hours. The apparatus includes a pocket for housing a folding door that is inserted between the end of a gondola island or wall fixture and a gondola end fixture. In one embodiment, the apparatus also includes an insert having a bracket on its exterior surface for receiving and locking an end of the folding door. In this embodiment, the insert is inserted between another gondola island or wall fixture and another gondola end fixture such that it opposes the pocket and is spaced apart from the pocket by the aisle. In another embodiment, the apparatus includes a vertical transom having a bracket on its surface for receiving and locking the end of the folding door. The vertical transom is mounted to a back of the gondola end fixture such that it opposes the pocket and is spaced apart from the pocket by the aisle. In still another embodiment, the bracket that receives and locks an end of the folding door can be mounted to a hard built wall. In this embodiment, the apparatus does not include an insert or another gondola island or wall fixture and a gondola end fixture and an aisle defined between the gondola fixture and hard wall can also be restricted from access.

The pocket can be either left handed (access to the folding door is on the left hand side of the pocket), right handed (access to the folding door is on the right hand side of the pocket) or both (there are two folding doors each accessible from one of the right hand side of the pocket or the left hand side of the pocket) depending on the aisle application. The innovation also includes one or more horizontal transoms extending across the aisle. Attached to a bottom of at least one of the horizontal transoms is a track for the folding door to move along when placing the folding door in a use state or in closed aisle configuration and for storing the folding door in a storage state or open aisle configuration.

Figure 1:
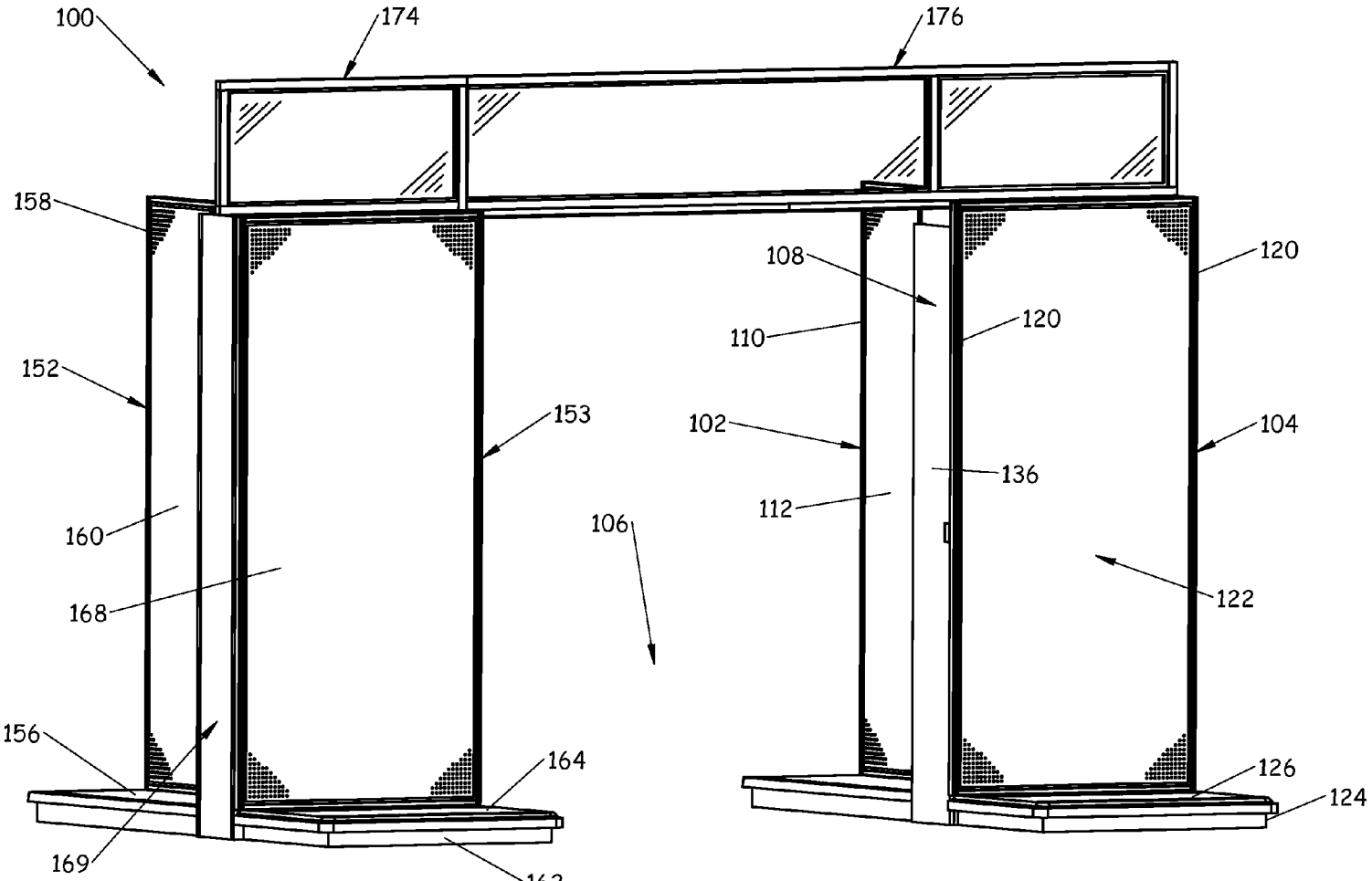
FIG. 1 is a perspective view of an apparatus for restricting access to an aisle in a retail store as illustrated in a storage state or open aisle configuration according to one embodiment.
Figure 2:
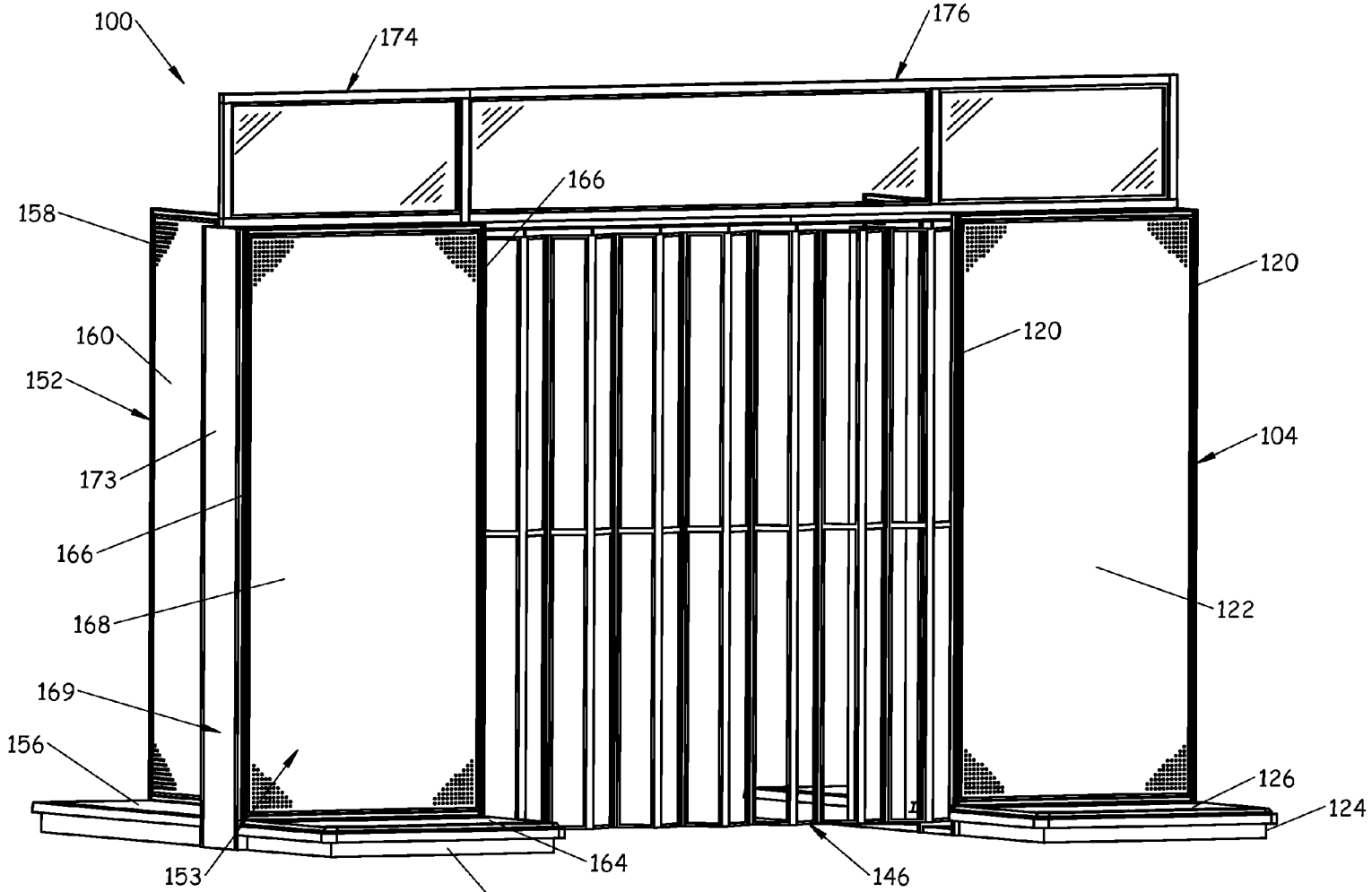
FIG. 2 is a perspective view of the apparatus illustrated in FIG. 1 in a use state or closed aisle configuration.
Figure 3:
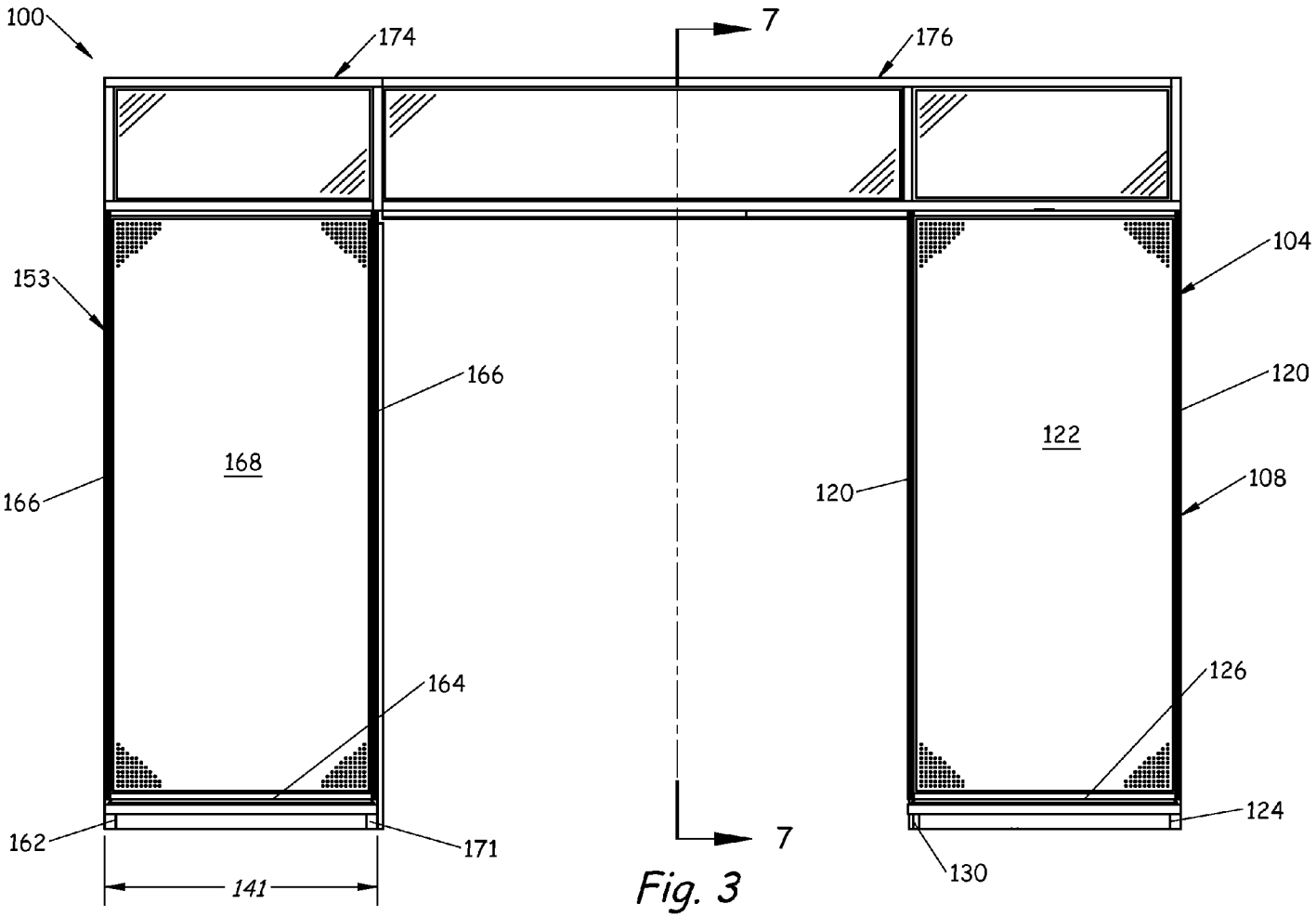
FIG. 3 is an end view of the apparatus illustrated in FIG. 1.
Figure 4:
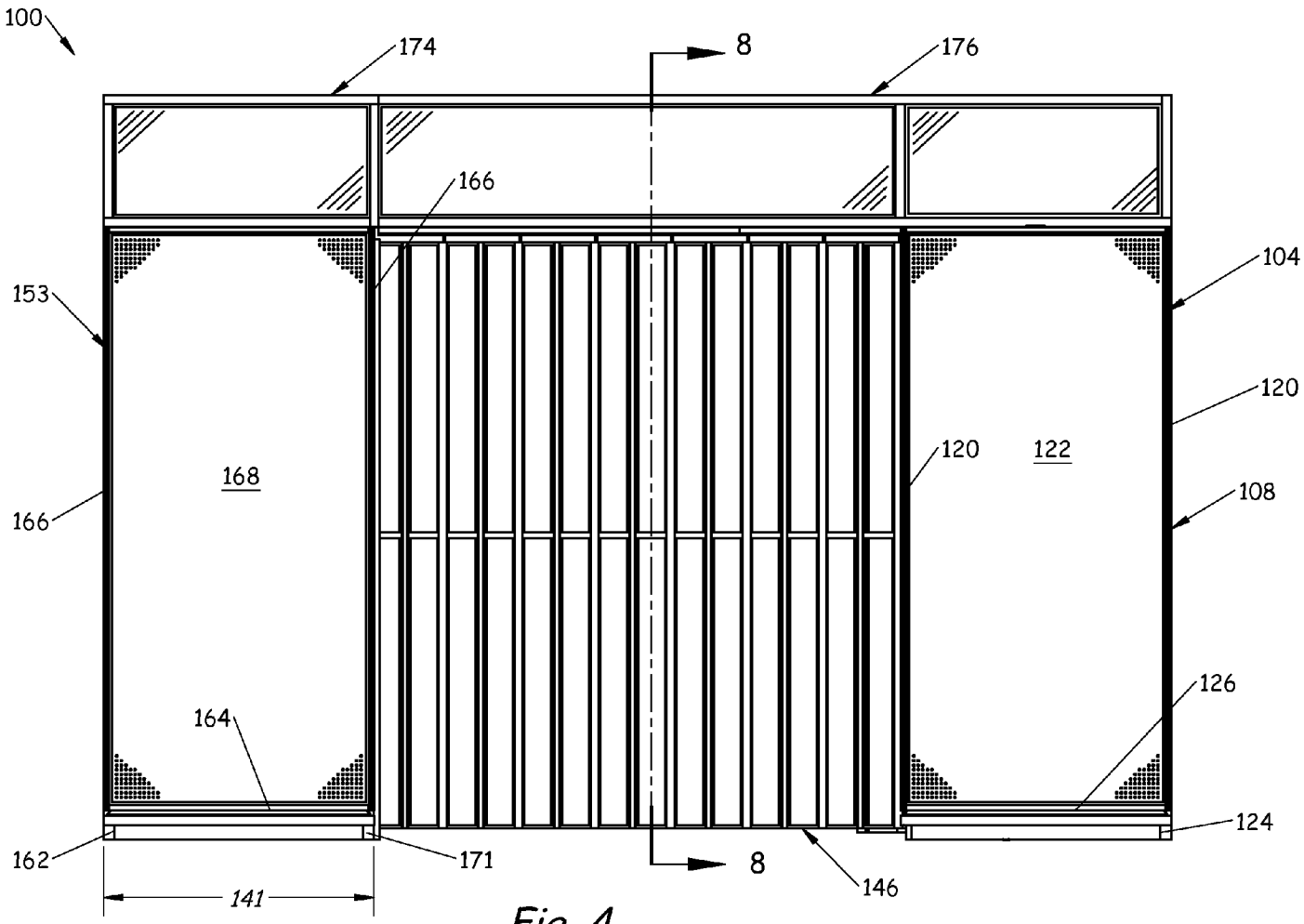
FIG. 4 is an end view of the apparatus illustrated in FIG. 2.
Figure 5:
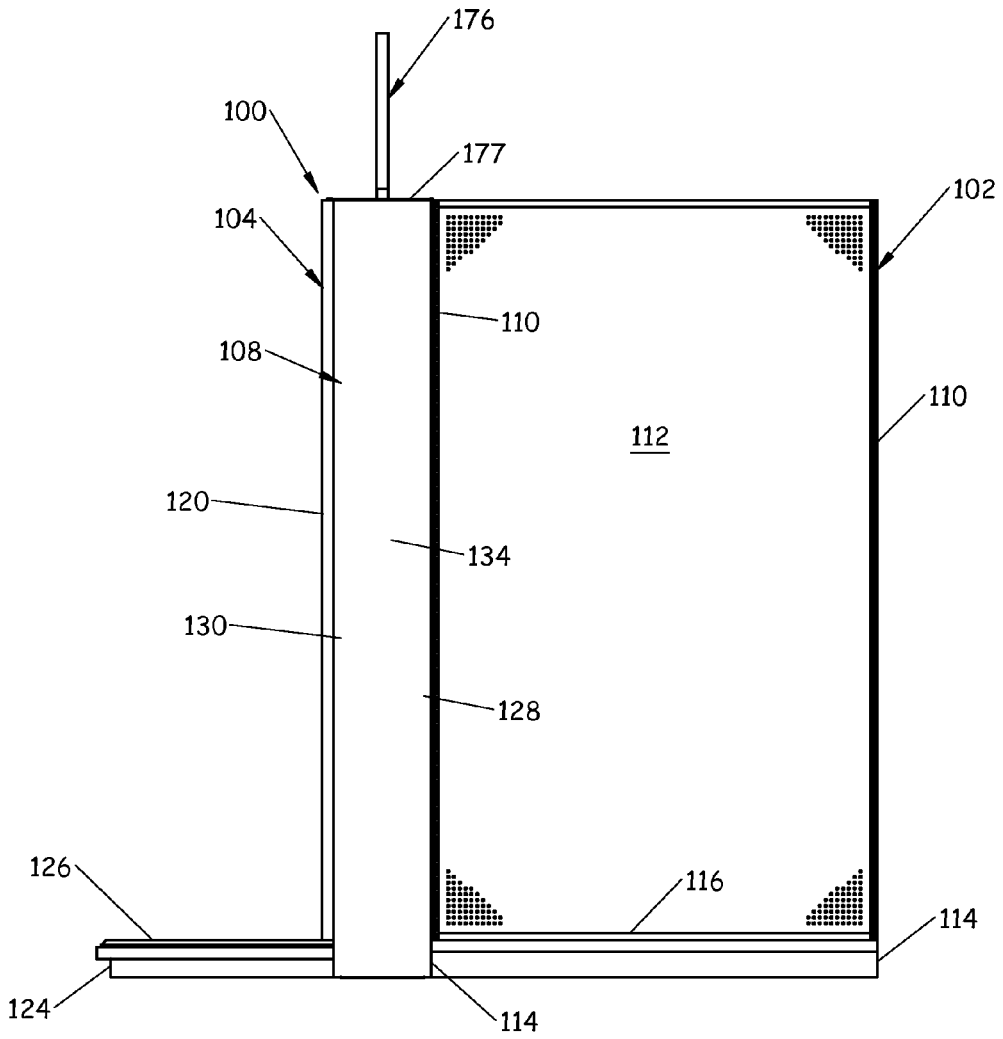
FIG. 5 is a right side view of the apparatus illustrated in FIGS. 1 and 2.
Figure 6:
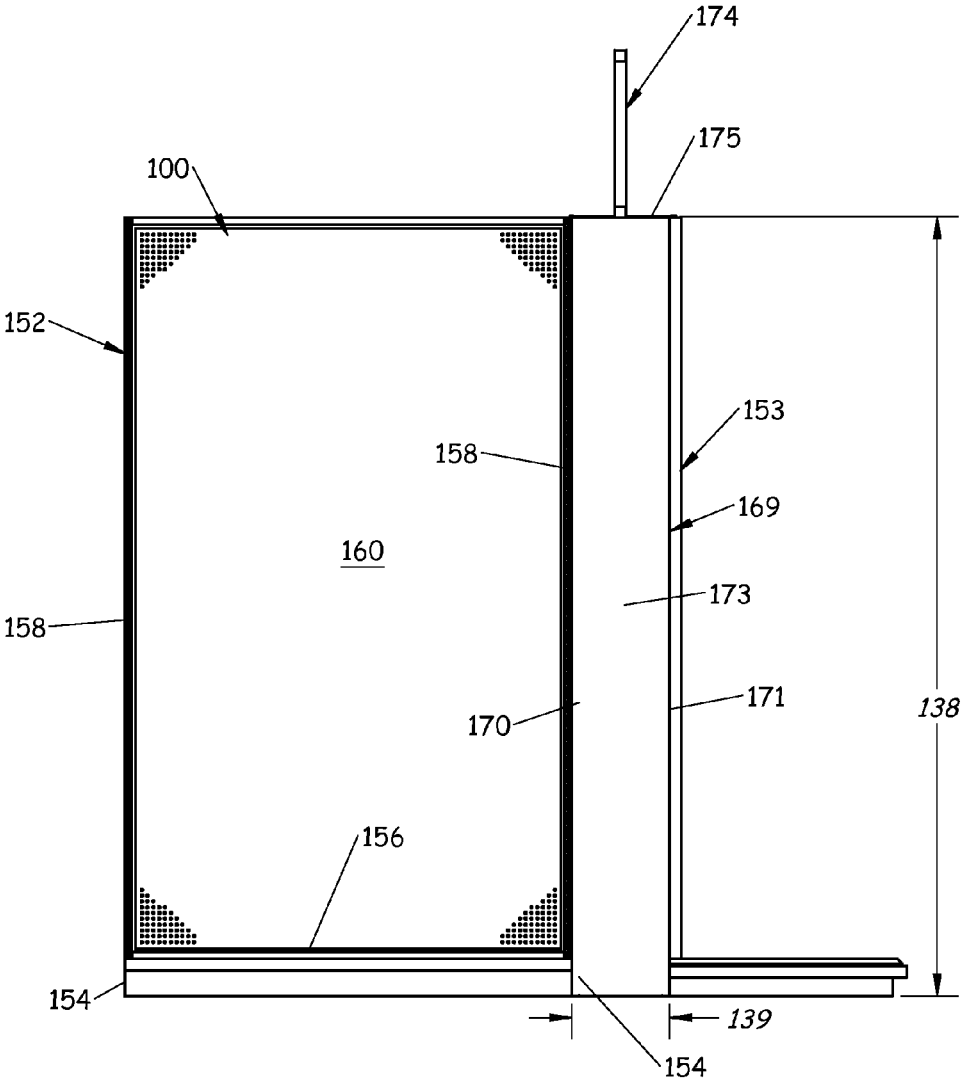
FIG. 6 is a left side view of the apparatus illustrated in FIGS. 1 and 2.
Figure 7:
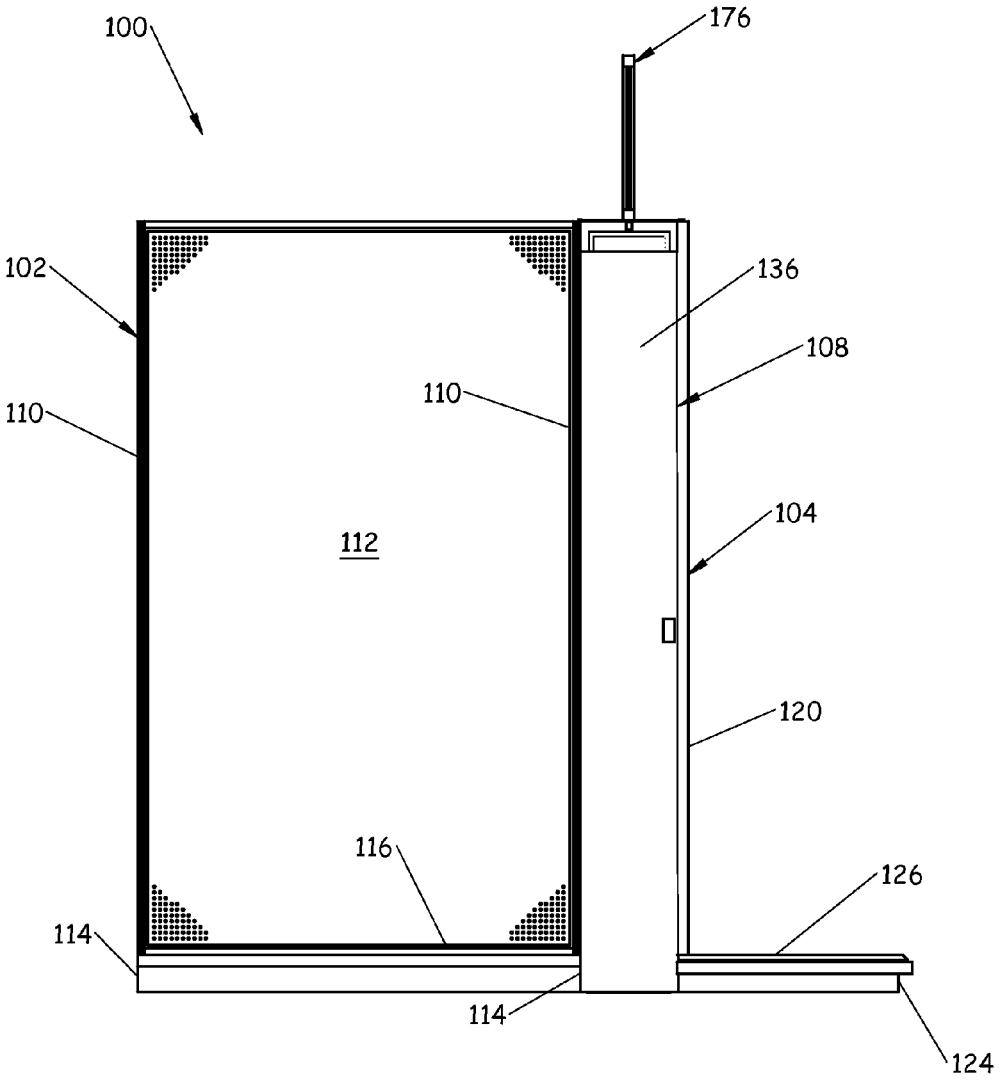
FIG. 7 is a section view of the apparatus illustrated in FIG. 1 taken through a line indicated in FIG. 3.
Figure 8:
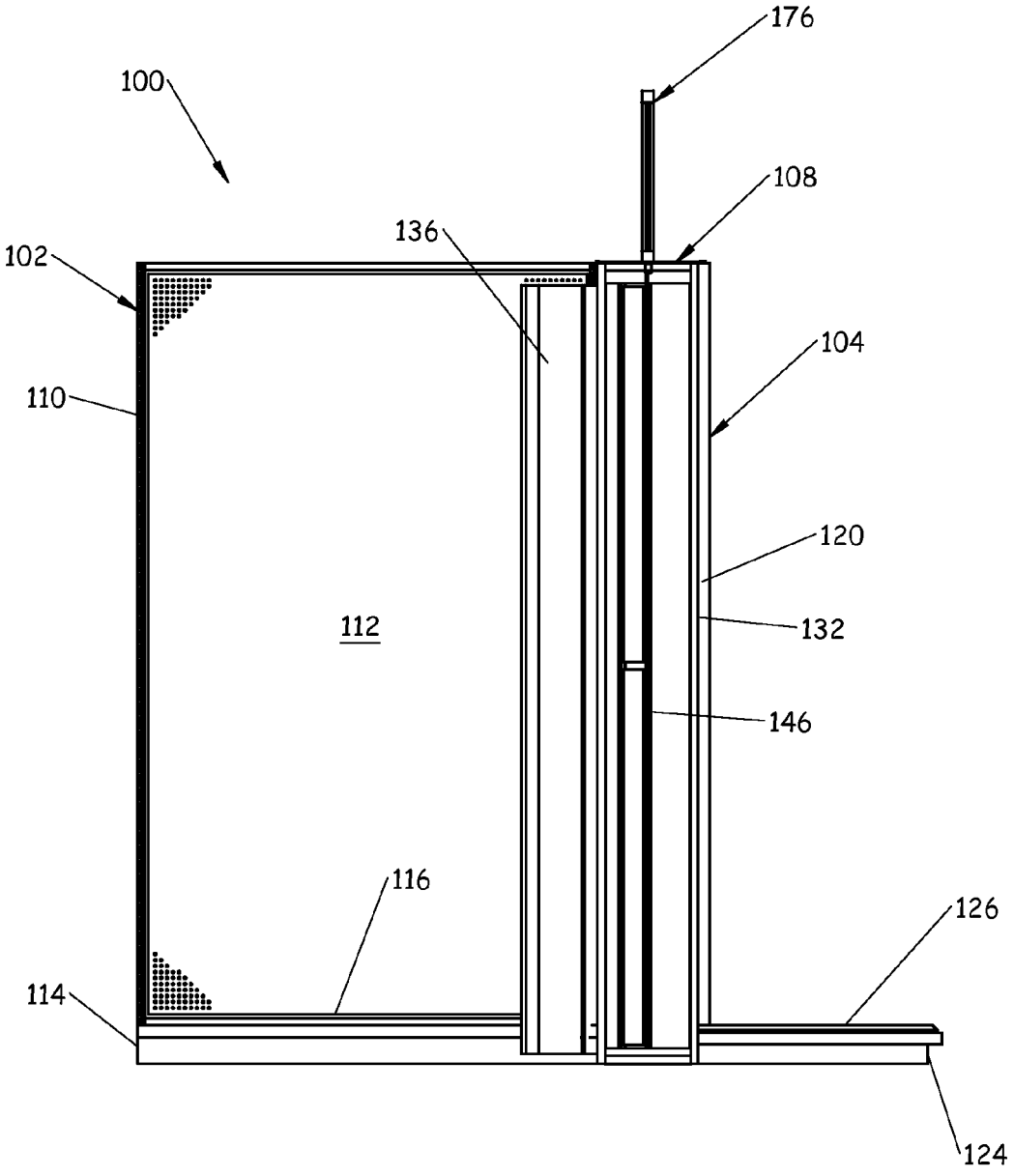
FIG. 8 is a section view of the apparatus illustrated in FIG. 2 taken through a line indicated in FIG. 4.

FIGS. 1 and 2 illustrate perspective views of an apparatus 100 for restricting access to an aisle in a retail store. In FIG. 1, apparatus 100 is in an open aisle configuration, while in FIG. 2, apparatus 100 is in a closed aisle configuration. FIG. 3 is an end view of apparatus 100 in the FIG. 1 configuration, FIG. 4 is an end view of apparatus 100 in the FIG. 2 configuration, FIG. 5 is a right side view of apparatus 100 in either the FIG. 1 configuration or the FIG. 2 configuration, FIG. 6 is a left side view of apparatus 100 in either the FIG. 1 configuration or the FIG. 2 configuration, FIG. 7 is a section view of apparatus 100 taken through a line indicated in FIG. 3 and FIG. 8 is a section view of apparatus 100 taken through a line indicated in FIG. 4.

Apparatus 100 includes a first retail display unit 102 for supporting one or more retail products and a second retail display unit 104 for supporting one or more retail products. Together, first retail display unit 102 and second retail display unit 104 define a portion of a side of an aisle 106. In one embodiment and as illustrated in FIG. 1, first retail display unit 102 is a gondola island fixture, and second retail display unit 104 is a gondola end fixture. However, first retail display unit 102 can also be a gondola wall fixture. Gondolas are freestanding retail display fixtures that include horizontally oriented bases and vertically oriented walls extending from the horizontally oriented bases. The vertically oriented walls include support features, such as notches, pegboards, flat walls, slat walls and etc. Gondolas can be fitted with shelving, peg hooks and other types of display components for displaying products or merchandise. A gondola island fixture includes the vertically oriented wall being located between two horizontally oriented bases such that the gondola island fixture is two-sided. A gondola wall fixture includes the vertically oriented wall being at the back of the horizontally oriented base such that the gondola wall fixture is one-sided Like the gondola wall fixture, the gondola end fixture also includes the vertically oriented wall being at the back of the horizontally oriented base such that the gondola end fixture is one-sided. However, the gondola end fixture also defines the beginning of or end of a row of gondola fixtures.

Typically, a gondola island fixture is positioned adjacent to a gondola end fixture to define a side and an end of an aisle or portion of an aisle. More particularly, a side of a gondola island fixture abuts a back of a gondola end fixture. As illustrated in FIGS. 5 and 7, first retail display unit 102 includes at least two base ends 114 (a gondola island fixture includes at least four), at least one substantially horizontally oriented base deck 116 (a gondola island fixture includes at least two) supported by and located between the two base ends 114, at least a pair of upright frame members 110 coupled to at least one of the base ends 114 and substantially vertically extending upwardly from the substantially horizontally oriented base deck 116 and at least one substantially vertically oriented upright panel 112 supported by and located between the pair of upright frame members 110. Second retail display unit or gondola end fixture 104 includes a base 124, a substantially horizontally oriented end deck 126 supported by the base 124, at least a pair of upright frame members 120 substantially vertically extending from end deck 126 and at least one substantially vertically oriented back panel 122 supported by and located between the pair of upright frame members 120.

Apparatus 100 includes a pocket or first cavity member 108 having a hollow interior defined by a first side 128, a second side 130 and opposing ends 132 and 134. End 132 of pocket 108 is an open end that is coverable by a hinged door 136 and faces aisle 106. As illustrated in FIGS. 1-8, first pocket 108 is sandwiched or inserted between first retail display unit 102 and second retail display unit 104 such that at least one of the base ends 114 of first retail display fixture 102 abuts first side 128 of pocket 108 and second side 130 of pocket 108 abuts a back of second retail display fixture 104.

Figure 9:
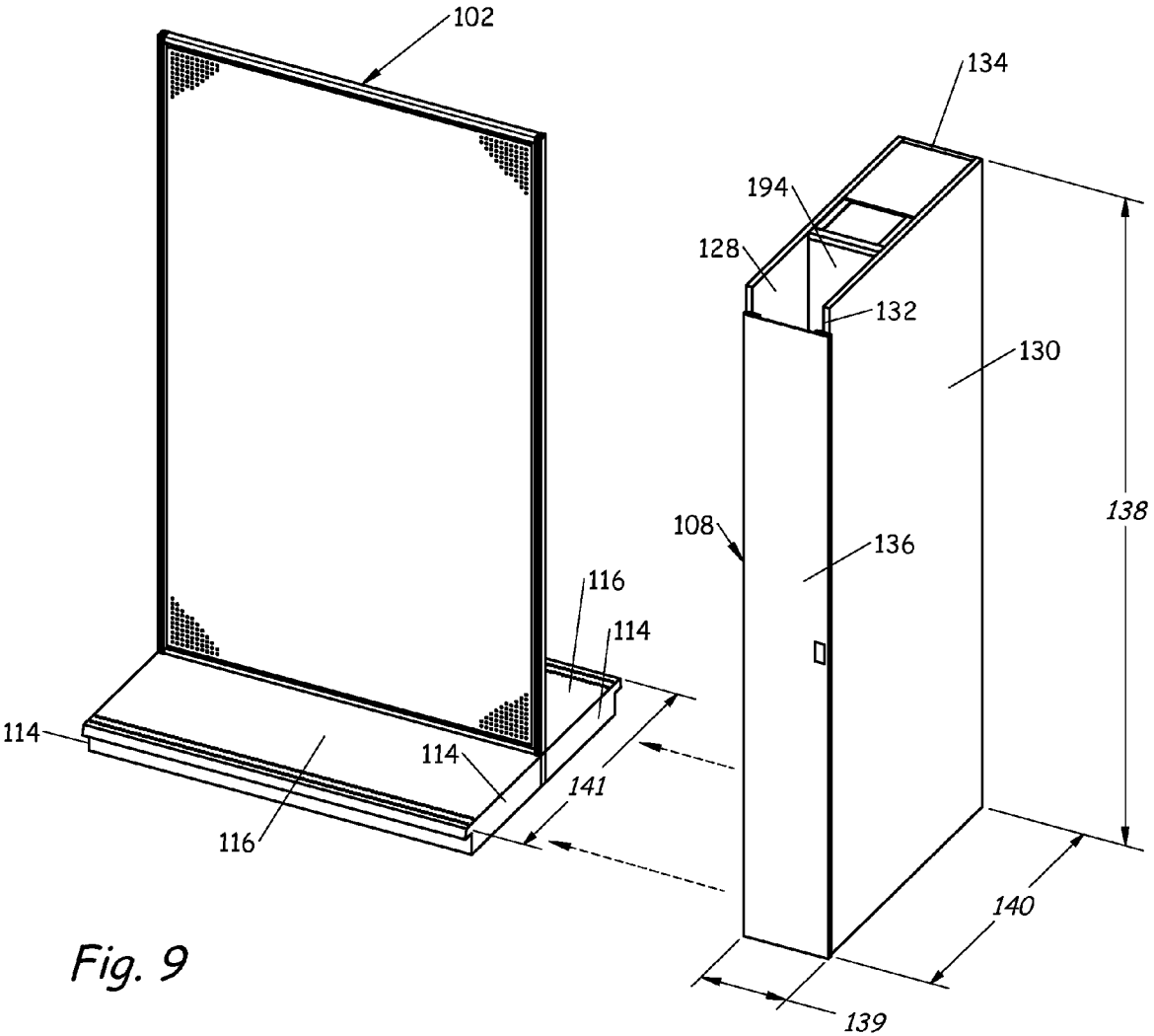
FIG. 9 is a perspective view of a pocket being mounted to a gondola island fixture in accordance with assembling the apparatus illustrated in FIGS. 1-8.

FIG. 9 is a perspective view of pocket 108 being mounted to first retail display fixture 102 in accordance with the assembling of apparatus 100. Pocket 108 includes a height 138, a width 139 and a depth 140. Depth 140 of pocket 108 is substantially similar to a depth 141 of first retail display unit 102 where depth 141 is the distance between front edges of the base decks 116 located on either side of upright panel 112. As illustrated by the arrows in FIG. 9, first side 128 of pocket 108 is mounted to one of the base ends 114 of first retail display unit 102 using fasteners (not shown). Therefore, depth 140 of pocket 108 is substantially aligned with depth 141 of first retail display unit 102 upon pocket 108 being assembled to first retail display unit 102.

Figure 10:
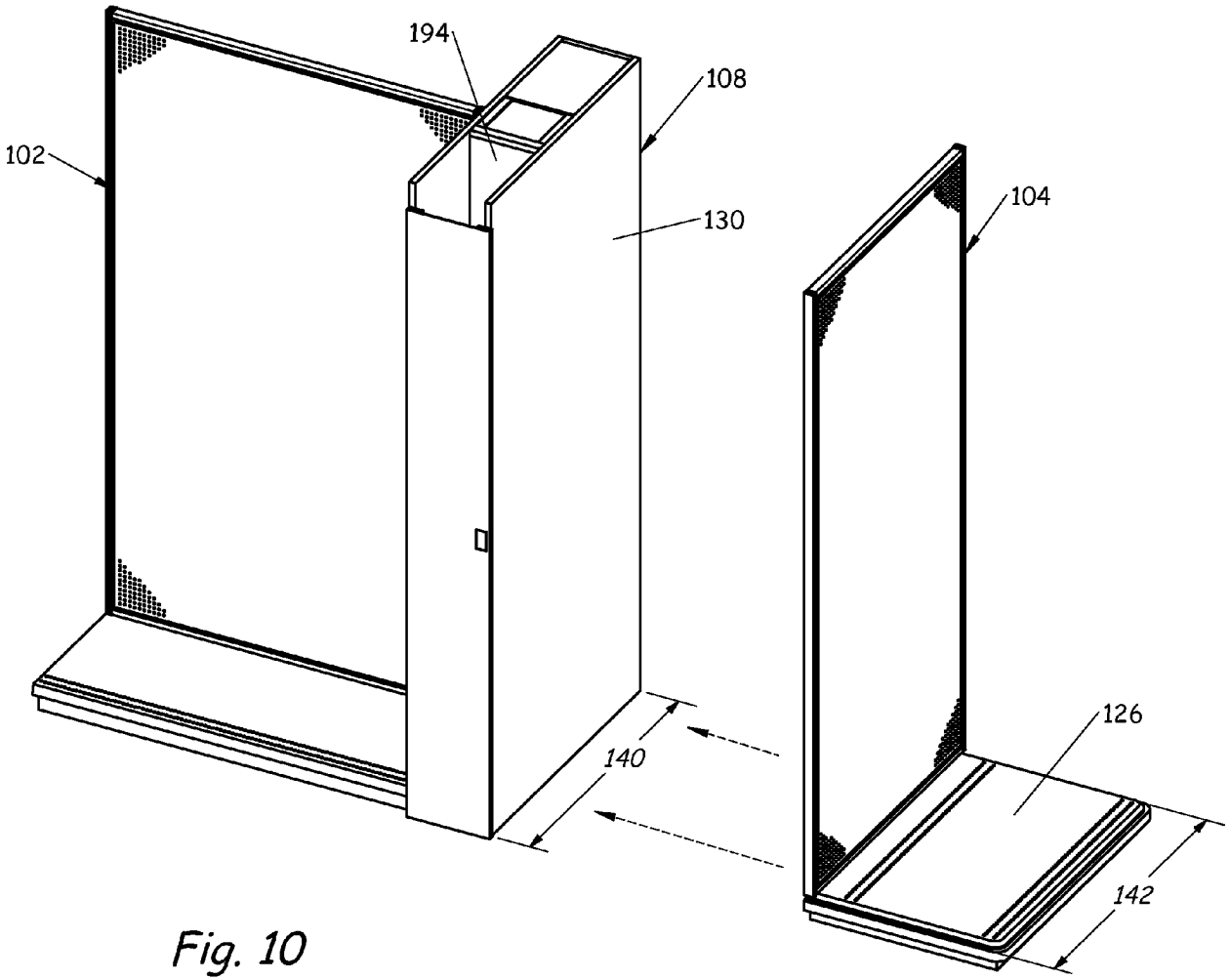
FIGS. 10-11 are perspective views of a gondola end fixture being mounted to the assembled pocket and gondola island fixture in accordance with assembling the apparatus illustrated in FIGS. 1-8.
Figure 11:
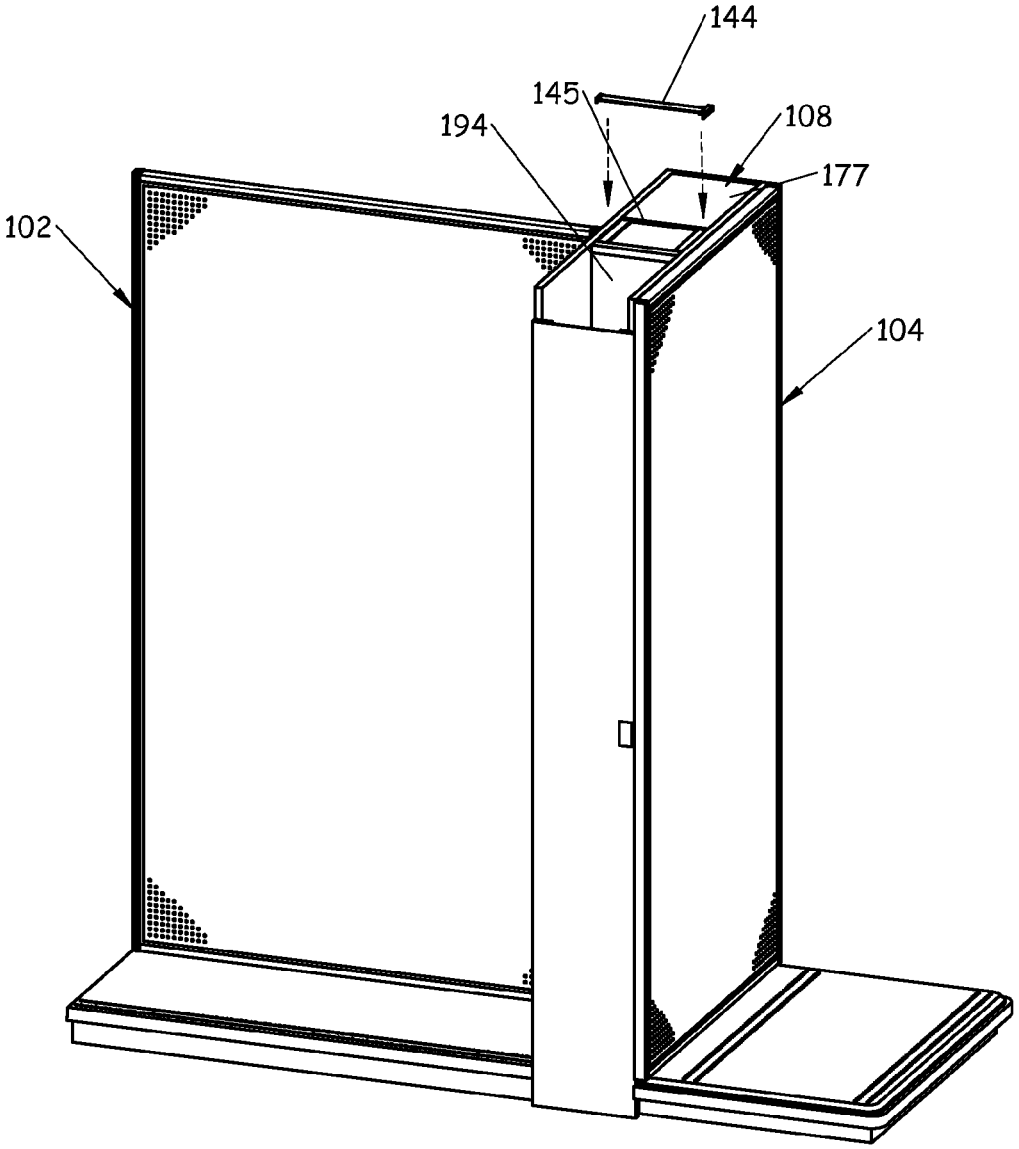

FIGS. 10-11 are perspective views of second retail display unit 104 being mounted to pocket 108 in accordance with the assembling of apparatus 100 illustrated in FIGS. 1-8. Second retail display fixture 104 includes a width 142 that is substantially similar to depth 140 of pocket 108. As illustrated by the arrows in FIG. 10, a back of end deck 126 of second retail display unit 104 is mounted to second side 130 of pocket 108. Therefore, width 142 of second retail display unit 104 is aligned with depth 140 of pocket 108 upon second retail display unit 104 being assembled to pocket 108. Furthermore, apparatus 100 includes a connector bracket 144 (FIG. 11). As illustrated by the arrows in FIG. 11, connector bracket 144 is placed in channel 145 located on top 177 of pocket 108 and secures the tops of second retail display unit 104 to first retail display unit 102.

With reference back to FIGS. 1-8, apparatus 100 includes a folding door or gate 146 coupled to and being completely located within the hollow interior of pocket 108 when in a storage state. In an open aisle configuration as illustrated in FIGS. 1, 3 and 7, hinged door 136 covers open end 132 of pocket 108 so that folding door or gate 146 is hidden from view and is located entirely in pocket 108. In a closed aisle configuration, as illustrated in FIGS. 2, 4 and 8, hinged door 136 is opened to uncover open end 132 so that folding door or gate 146 can be moved or extended from the hollow interior of pocket 108 through open end 132 and away from first retail display unit 102 to be extended across aisle 106 when in use. When closed, hinged door 136 conceals folding door or gate 146 within pocket 108. Folding door or gate 146 will be discussed in detail in regards to FIGS. 15-16.

Apparatus 100 also includes a third retail display unit 152 for supporting one or more retail products and a fourth retail display unit 153 for supporting one or more retail products.

Third retail display unit 152 and fourth retail display unit 153 are spaced apart from first retail display unit 102 and second retail display unit 104 to define aisle 106. In one embodiment and as illustrated in FIG. 1, third retail display unit 152 is a gondola island fixture, and fourth retail display unit 153 is a gondola end fixture. However, third retail display unit 152, as is the case with first retail display unit 102, can also be a gondola wall fixture. Third retail display unit 152 includes at least two base ends 154 (a gondola island fixture includes four), at least one substantially horizontally oriented base deck 156 (a gondola island fixture includes two) supported by and located between the at least two base ends 154, at least a pair of upright frame members 158 substantially vertically extending from the at least one substantially horizontally oriented base deck 156 and at least one back panel 160 supported by and located between the pair of upright frame members 158. Fourth retail display unit 153 includes a base 162, a substantially horizontally oriented end deck 164 supported by the base 162, at least a pair of upright frame members 166 substantially vertically extending from the substantially horizontal end deck 164 and at least one substantially vertically oriented back panel 168 supported by and located between the pair of upright frame members 166.

Apparatus 100 further includes an insert or second cavity member 169 having an enclosed hollow interior defined by a first side 170, a second side 171 and opposing ends 172 (illustrated in FIG. 17) and 173. As illustrated in FIGS. 1-8, insert 168 is sandwiched or inserted between third retail display unit 152 and fourth retail display unit 153 such that one of the two base ends 154 of third display unit 152 abuts first side 170 of insert 168 and second side 171 of insert 168 abuts a back of fourth retail display unit 153. As illustrated in more detail and as will be described below, end 172 of insert 169 faces aisle 106 and is a closed end. In particular, folding door or gate 146 is fixed to end 172 of insert 169 when in the closed aisle configuration and will be discussed in detail below.

Although FIG. 9 is a perspective view of pocket 108 being mounted to first retail display unit 102, insert 169 being mounted to third retail display unit 152 is substantially similar. The dimensions of insert 169 are substantially similar to the dimensions of pocket 108 and also includes a height 138 (FIG. 6), a width 139 (FIG. 6) and a depth 140 (FIG. 3). Depth 140 of insert 169 is substantially similar to a depth of third retail display unit 152 and therefore also first display unit 102 where the depth of third retail display unit 152 is the distance between front edges of the base decks 156 located on either side of upright panel 160. First side 170 of insert 169 is mounted to one of the base ends 154 of third retail display unit 152 using fasteners. Therefore, depth 140 of insert 169 is aligned with the depth of third retail display unit 152 upon insert 169 being assembled to third retail display unit 152.

Although FIGS. 10-11 are perspective views of second retail display unit 104 being mounted to pocket 108 in accordance with the assembling of apparatus 100, fourth retail display unit 153 being mounted to insert 169 is substantially similar. Fourth retail display unit 153 includes a width 141 (FIG. 3) that is substantially similar to depth 140 of insert 169. As illustrated by the arrows in FIG. 10, a back of end deck 164 of fourth retail display unit 153 is mounted to second side 171 of insert 169. Furthermore, apparatus 100 includes a second connector bracket. Like connector bracket 144 (FIG. 11), the second connector bracket is placed in a channel on a top 175 of insert 169 and secures third retail display unit 152 to second retail display unit 153. Therefore, width 141 of fourth retail display unit 153 is aligned with depth 140 of insert 169 upon fourth retail display unit 153 being assembled to insert 169.

Figure 12:
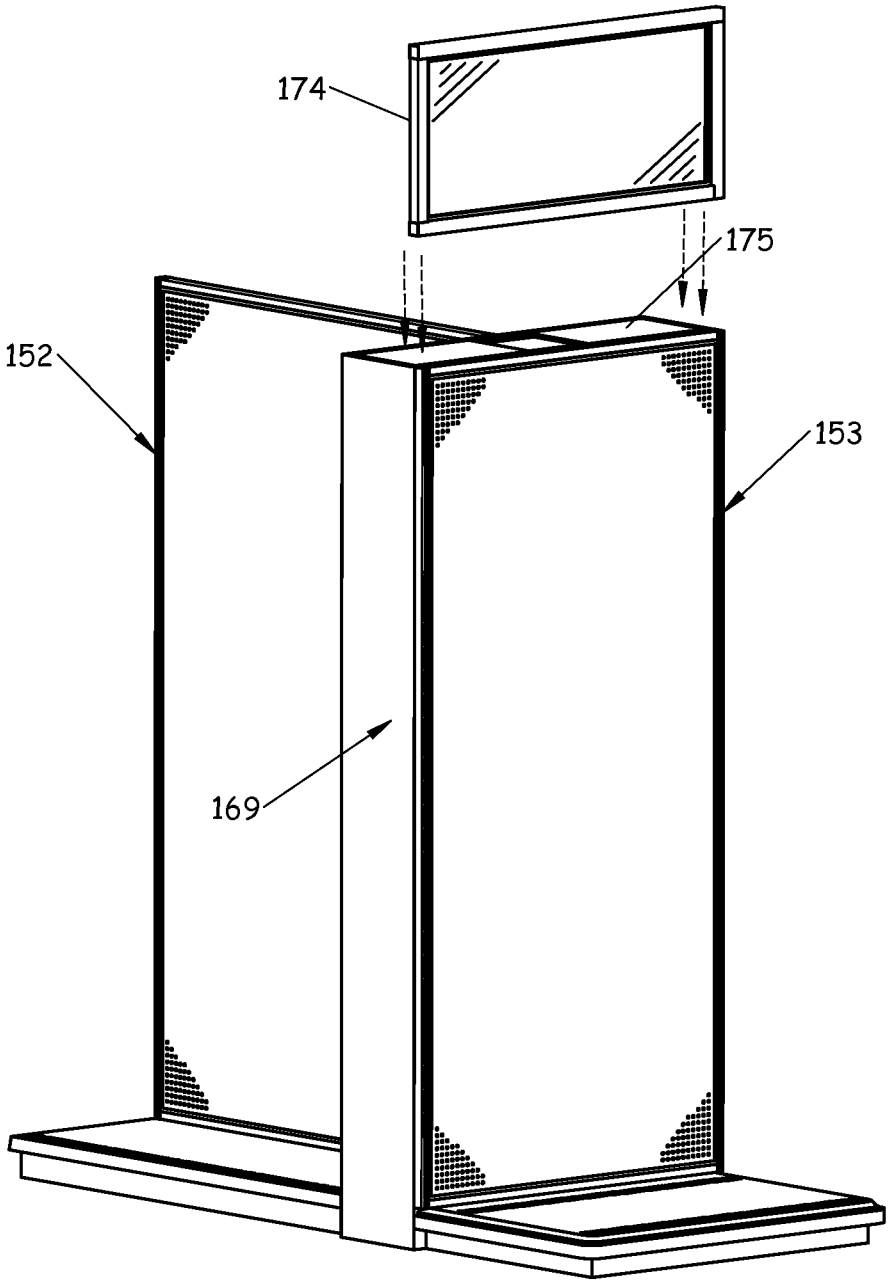
FIG. 12 is a perspective view of a horizontal transom being mounted to a top of an insert in accordance with assembling the apparatus illustrated in FIGS. 1-8.

With further reference back to FIGS. 1-8, apparatus 100 also includes a first frame member or first transom 174 that is attached to or mounted to top 175 of insert 169. FIG. 12 is a perspective view of transom 174 being mounted to insert 169. As illustrated by the arrows in FIG. 12, transom 174 is fastened to top 175 of insert 169 and a right side of transom 174 includes associated hardware for coupling to another transom. First transom 174 is configured to support a window, such as a window made of transparent or translucent glass or plastic.

Figure 13:
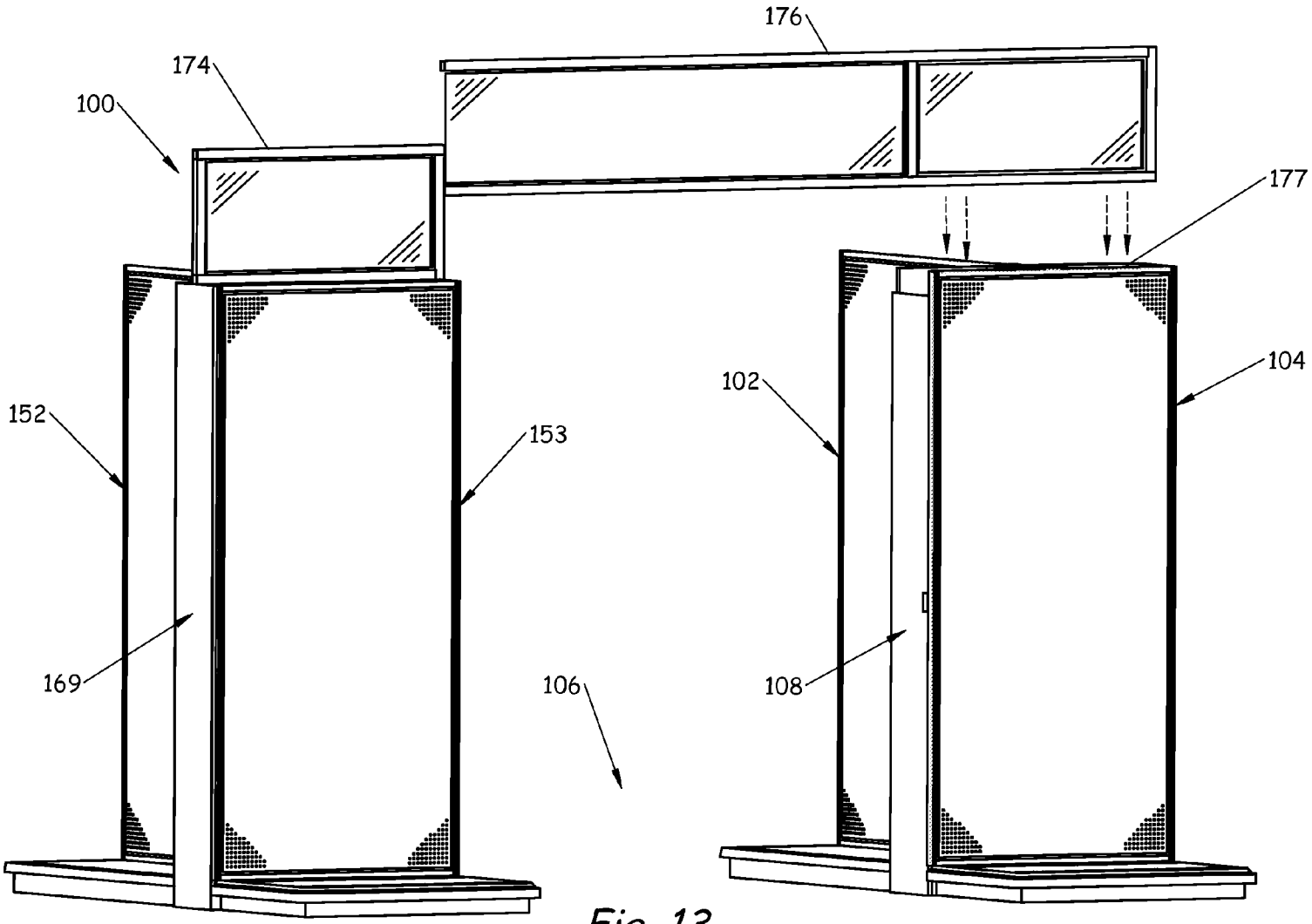
FIG. 13 is a perspective view of a horizontal transom being mounted to a top of a pocket in accordance with assembling the apparatus illustrated in FIGS. 1-8.

Apparatus 100 also includes a second frame member or second transom 176 (FIGS. 1-5 and 6-8) that is attached to or mounted to top 177 of pocket 108. FIG. 13 is a perspective view of second transom 176 being mounted to pocket 108. As illustrated by the arrows in FIG. 13, second transom 176 is fastened to top 177 of first pocket 108. A left side of second transom 176 is attached to the hardware on first transom 174. Therefore, second transom 176 extends over and across aisle 106 and connects pocket 108 to insert 169. As does first transom 174, second transom 176 is configured to support one or more windows, such as a window made of transparent or translucent glass or plastic, within the frame member of the transom.

Figure 14:
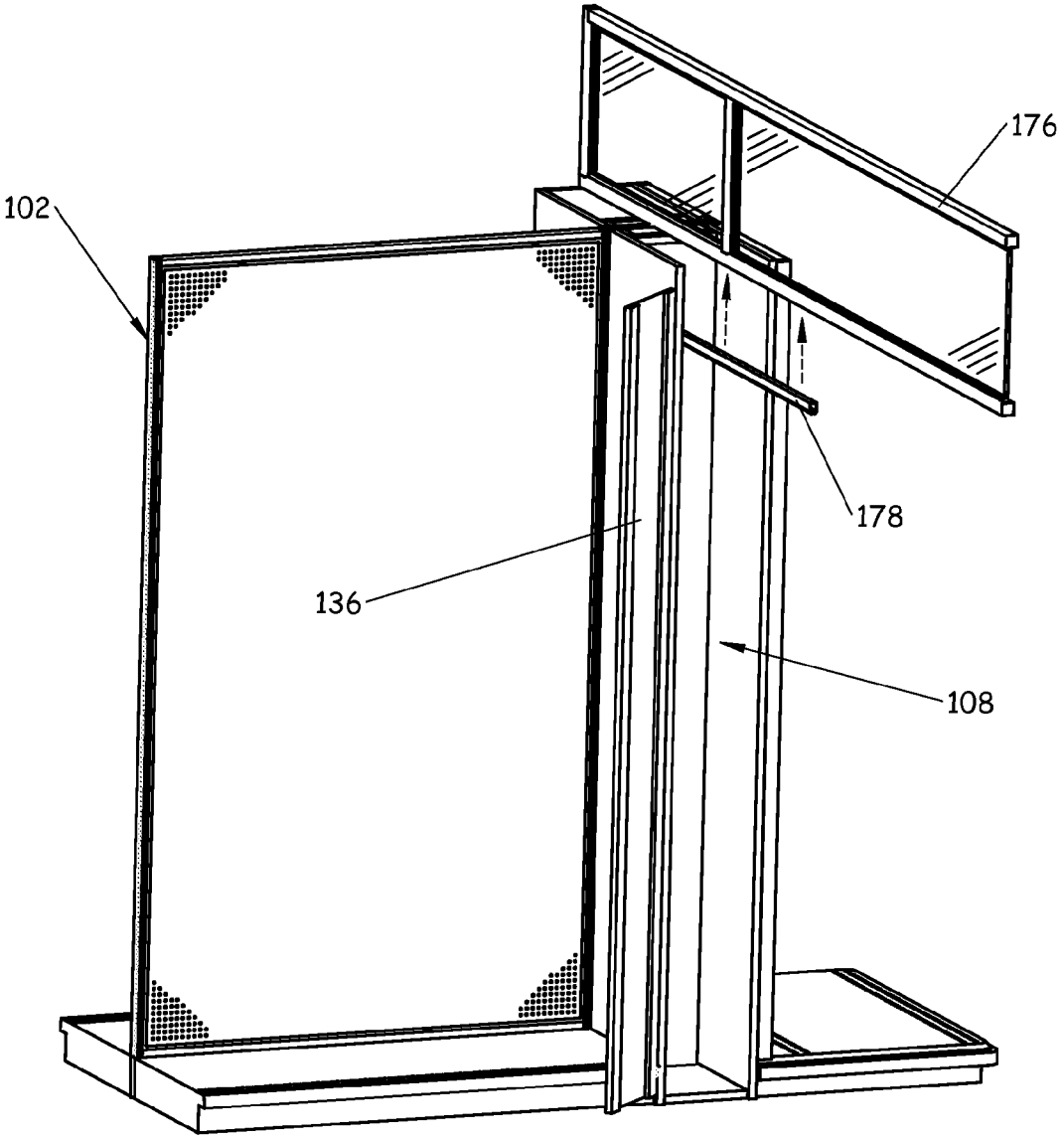
FIG. 14 is a perspective view of a track being mounted to a bottom of the horizontal transom that extends across the aisle in accordance with assembling the apparatus illustrated in FIGS. 1-8.

FIG. 14 is a perspective view of a track 178 being mounted to a bottom of transom 176 that extends across aisle 106. As illustrated by the arrows in FIG. 14, track 178 is coupled or fastened to the bottom of transom 176 so that it can receive folding door or gate 146 and provide a slidable coupling between gate 146 and transom 176.

Figure 15:
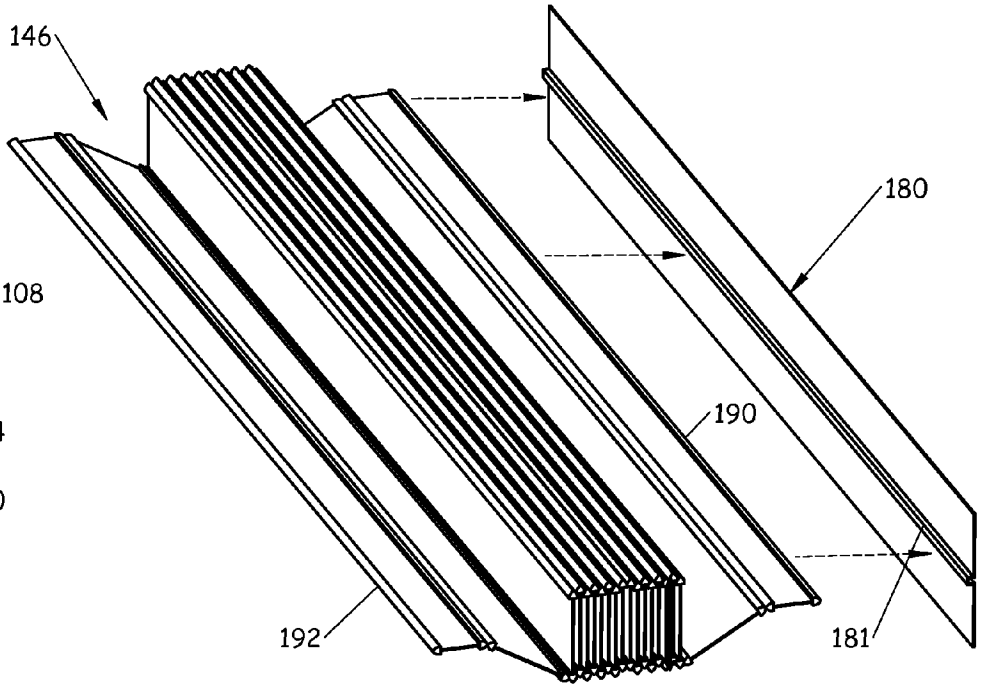
FIG. 15 is a perspective view of a gate being mounted to a flange in accordance with assembling the apparatus illustrated in FIGS. 1-8.
Figure 16:
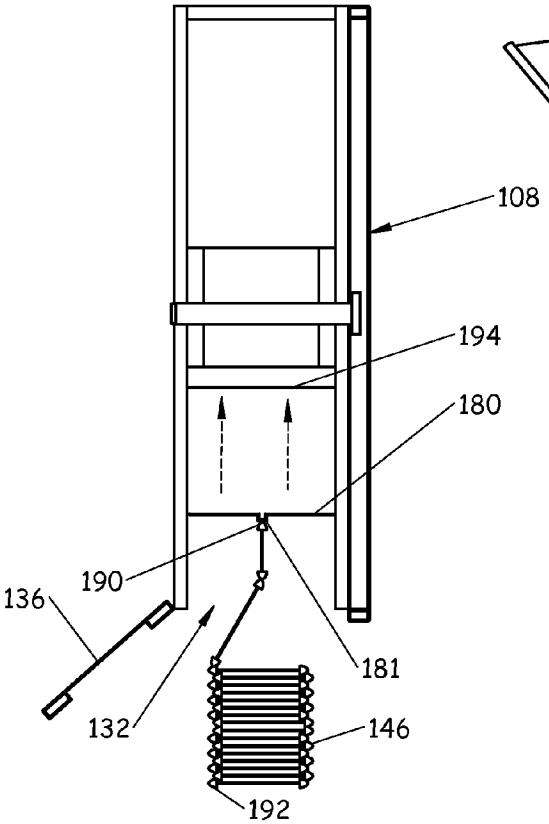
FIG. 16 is a diagrammatic top view of the flange and gate shown in FIG. 15 being mounted to an interior of the pocket in accordance with assembling the apparatus illustrated in FIGS. 1-8.

FIG. 15 is a perspective view of folding door or gate 146 being mounted to a flange 180. Folding door or gate 146 includes a fixed end 190 and a lockable end 192. As illustrated by the arrows in FIG. 15, fixed end 190 of folding door or gate 146 is coupled or fastened to a channel 181 in flange 180. FIG. 16 is a top diagrammatic view of flange 180 being mounted to the interior of pocket 108. As illustrated by the arrows in FIG. 16, flange 180 is moved into the interior of pocket 108 and mounted to an interior wall 194 (also illustrated in FIGS. 9-11) located in a center of pocket 108. In this way, gate 146 can be folded, for example in an accordion style, and both fixed end 190 and lockable end 192 can be stored or located entirely within pocket 108 when in the open aisle configuration as illustrated in FIGS. 1 and 3.

Figure 17:
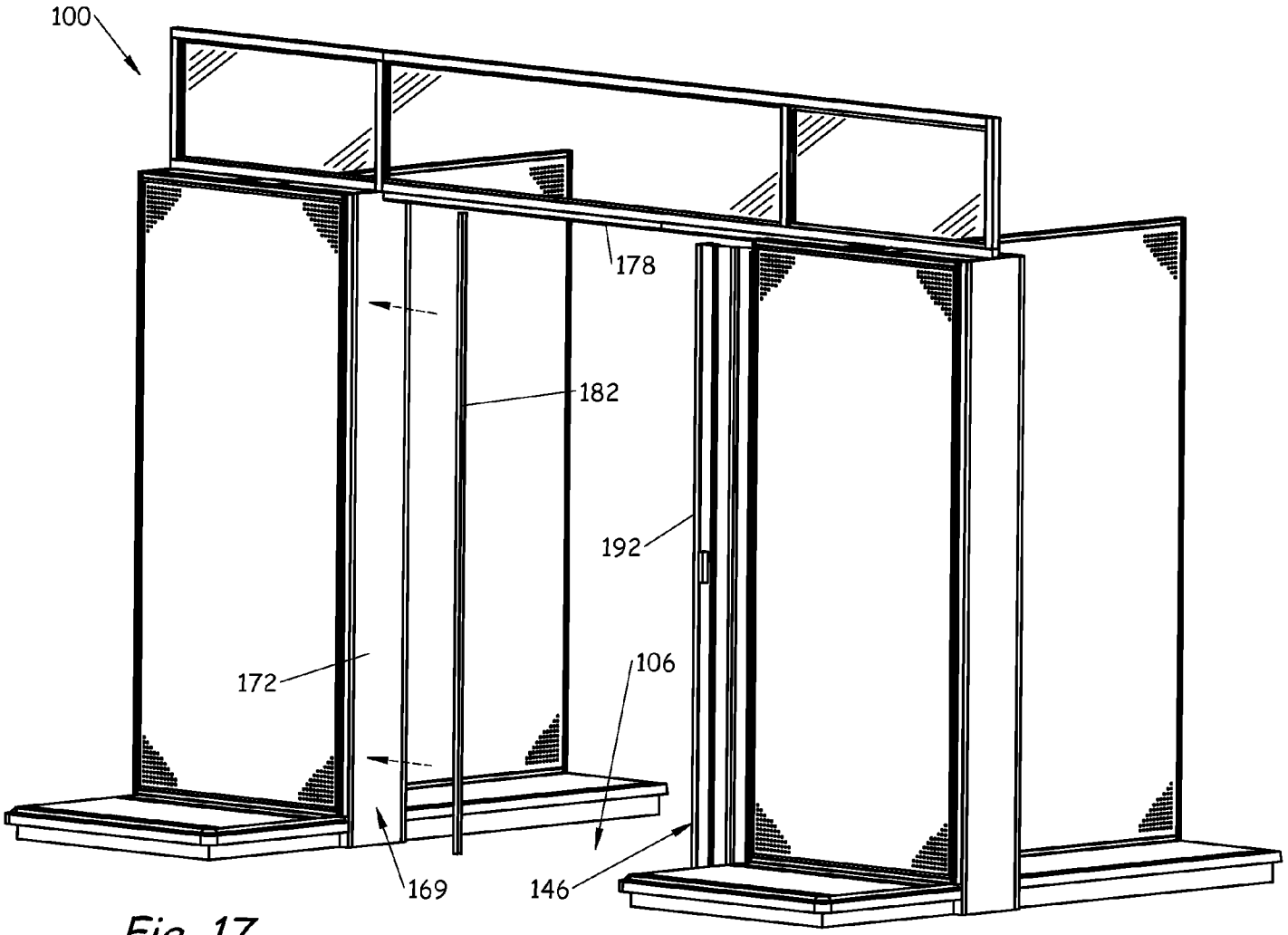
FIG. 17 is a perspective view of a bracket being mounted to an end of the insert in accordance with assembling the apparatus illustrated in FIGS. 1-8.

FIG. 17 is a perspective view of apparatus 100 including a bracket 182 being mounted to end 172 of insert 169. As illustrated by the arrows in FIG. 17, bracket 182 is coupled to or mounted to end 172 of insert 169, which faces aisle 106. To put apparatus 100 into the closed aisle configuration, hinged door 136 (FIGS. 1, 7 and 8) is opened, lockable end 192 of gate 146 is moved through open end 132 of pocket 108 along track 178 and extended across aisle 106. Lockable end 192 of gate 146 is then attached to bracket 182 located on end 172 of insert 169. Lockable end 192 of gate 146 mates with bracket 182 and when operated together lock gate 146 in place so that gate 146 cannot be moved back into pocket 108 without first being unlocked.

Figure 18:
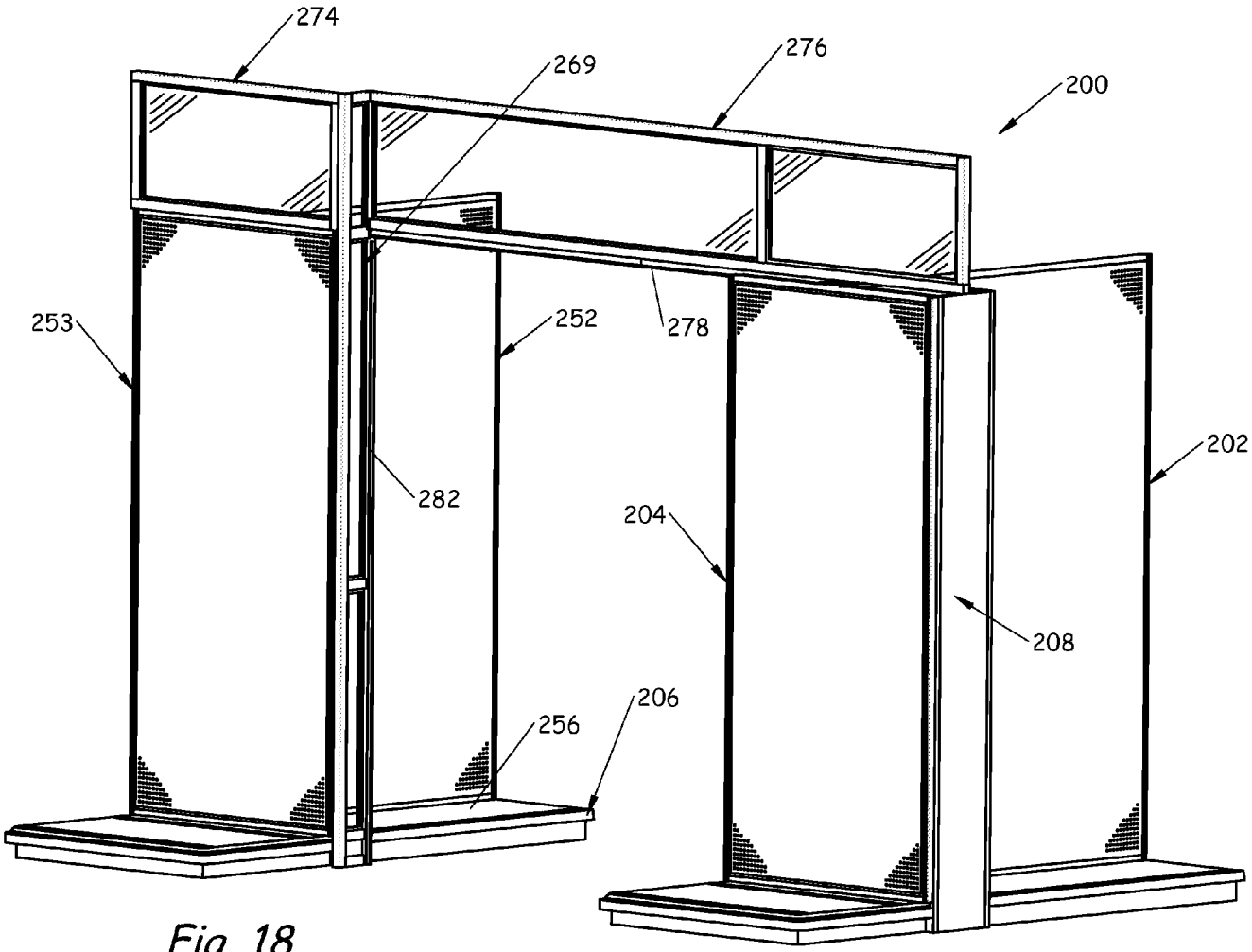
FIG. 18 is a perspective view of an apparatus for restricting access to an aisle in a retail store as illustrated in a storage state or open aisle configuration according to another embodiment.
Figure 19:
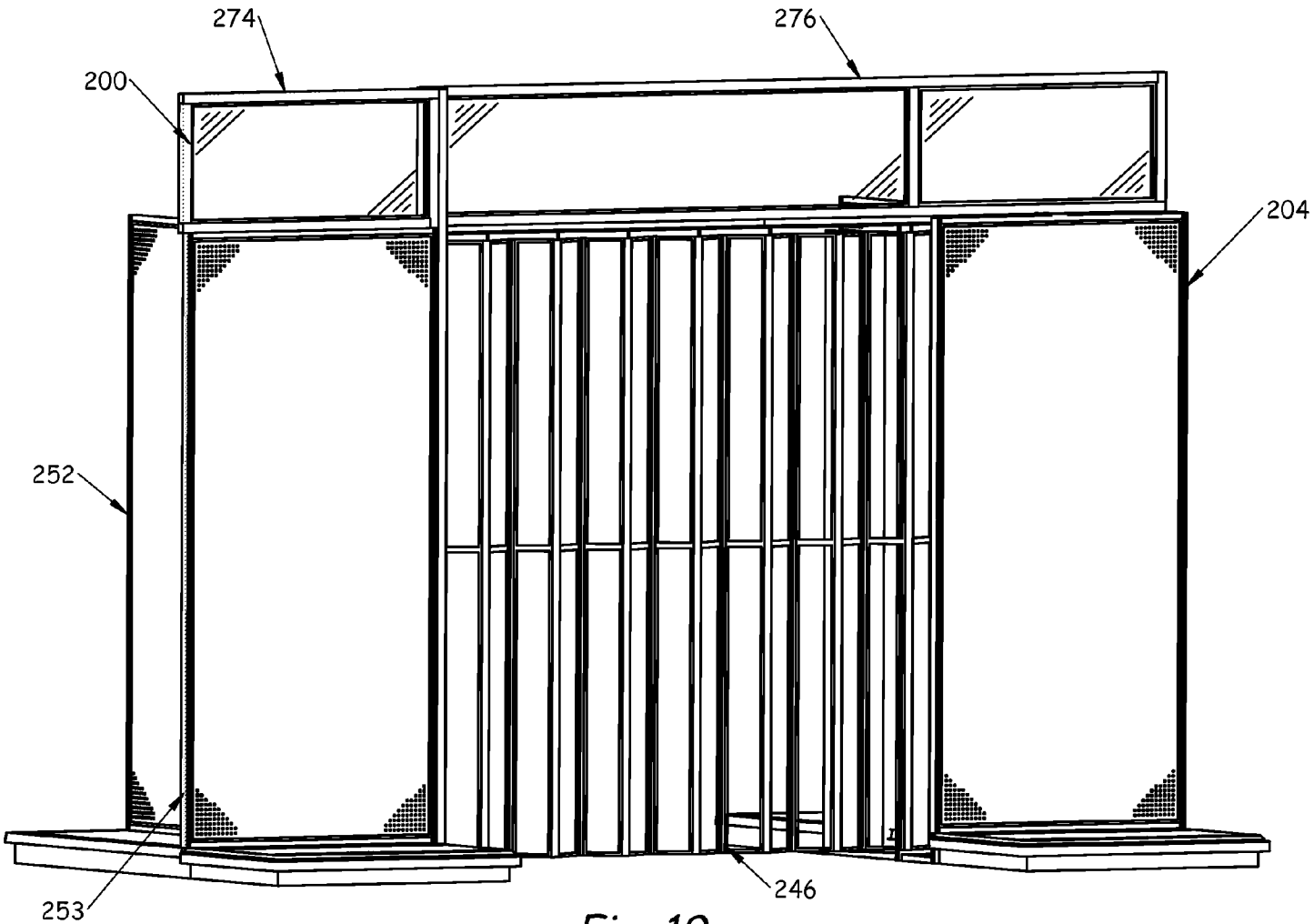
FIG. 19 is a perspective view of the apparatus illustrated in FIG. 18 in a use state or closed aisle configuration.

FIGS. 18 and 19 illustrate perspective views of an apparatus 200 for restricting access to an aisle 206 in a retail store in accordance with another embodiment. In FIG. 18, apparatus 200 is in an open aisle configuration, while in FIG. 19, apparatus 200 is in a closed aisle configuration. Apparatus 200 is similar to apparatus 100 in that apparatus 200 includes a first retail display unit (or gondola island fixture) 202, a second retail display unit (or gondola end fixture) 204, a pocket or first cavity member 208 located between first retail display unit 202 and second retail display unit 204 and configured to store a folding door or gate 246, a third retail display unit (or gondola island fixture) 252 and a fourth retail display unit (or gondola end fixture) 253.

Figure 20:
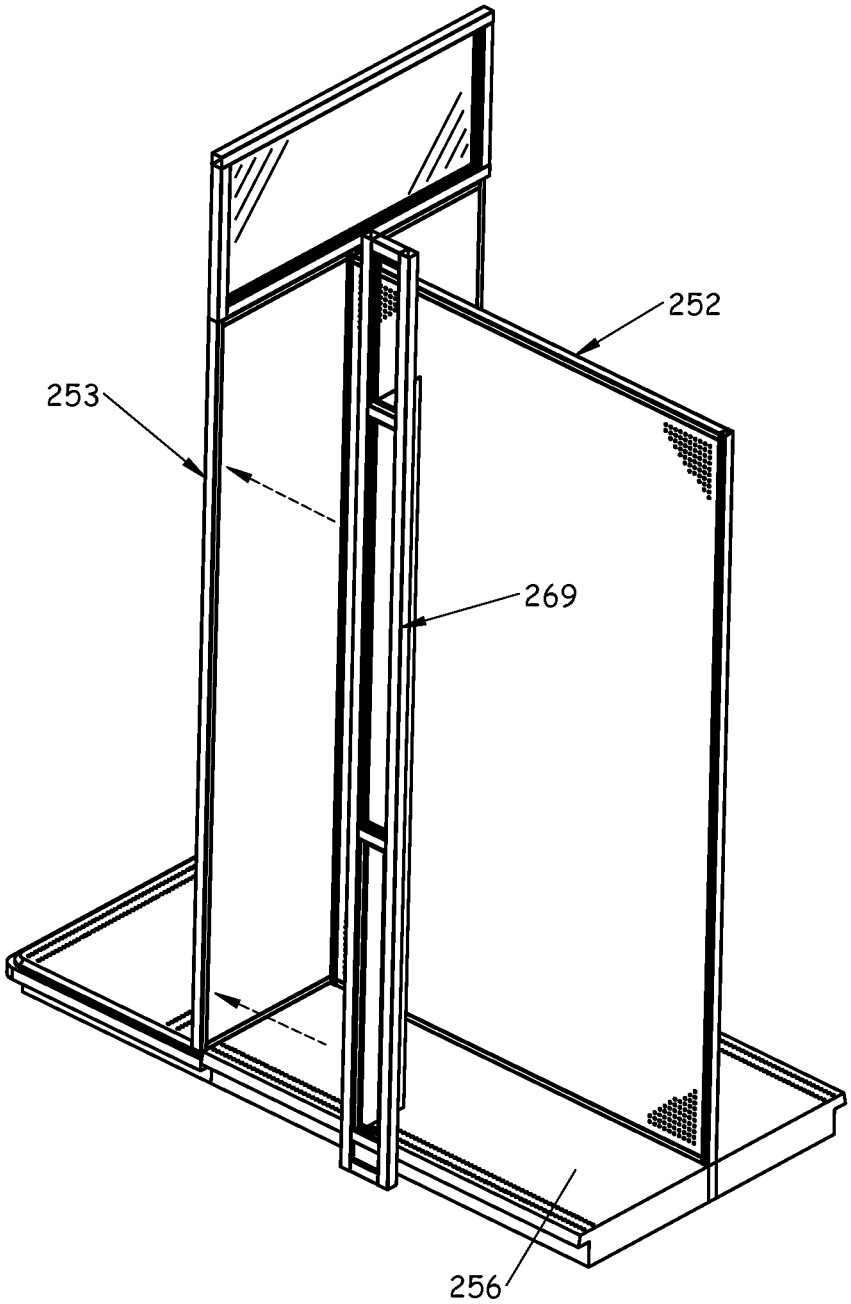
FIG. 20 is a perspective view of a vertical transom being mounted to an associated gondola island fixture and gondola end fixture in accordance with assembling the apparatus illustrated in FIGS. 18-19.

Rather than apparatus 200 including an insert or second cavity member like insert 169 of apparatus 100, apparatus 200 includes a vertical extending frame member or vertical transom 269. FIG. 20 is a perspective view of vertical transom 269 being mounted (as illustrated by the arrows in FIG. 20) to a back of fourth retail display unit 253 and being situated to vertically extend upwards from a base deck 256 of third retail display unit 252. Therefore, vertical transom 269 faces aisle 206 and provides a surface for a bracket 282 to be attached to so that a lockable end of gate 246 can be locked to third retail display unit 252. Vertical transom 269 also couples to a horizontal transom 276 to help support the frame member that extends across aisle 206 and provides a track 278 for gate 246 to move along. Vertical transom 269 also couples to a horizontal transom 274, which is coupled to a top of fourth display unit 253 rather than an insert.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. An apparatus comprising:

a first retail display unit for supporting one or more retail products a second retail display unit for supporting one or more retail products;

a pocket located between the first retail display unit and the second retail display unit such that a first side of the pocket is mounted to a first side of the first retail display unit and a second side of the pocket is mounted to a back of the second retail display unit, the pocket having a hollow interior and an open end; and a gate having a fixed end coupled to the hollow interior of the pocket and a lockable end, the fixed and lockable ends being located within the hollow interior of the pocket when the gate is in storage and the lockable end being extended through the at least one open end of the pocket and away from the first retail display unit when the gate is moved into use.

2. The apparatus of claim 1, further comprising:

a third retail display unit for supporting one or more retail products; and a fourth retail display unit for supporting one or more retail products, wherein the third and fourth retail display units are spaced apart from the first and second retail display units so as to define part of an aisle; and an insert located between the third retail display unit and the fourth retail display unit such that a first side of the insert is mounted to a side of the third retail display unit and a second side of the insert is mounted to a back of the fourth retail display unit; and wherein the lockable end of the gate is locked to an exterior surface of the insert that faces the aisle when the gate is in use.

3. The apparatus of claim 2, wherein the insert comprises an enclosed hollow interior.

4. The apparatus of claim 2, further comprising at least one frame member that is attached to tops of the pocket and the insert and extends across the aisle.

5. The apparatus of claim 4, wherein the at least one frame member further comprises a track so that the gate slidably couples to the at least one frame member.

6. The apparatus of claim 5, wherein the at least one frame member comprises a transom window located above the track.

7. The apparatus of claim 1, wherein the first retail display unit and the second retail display unit comprise shelving retail display units.

8. The apparatus of claim 1, wherein the pocket further comprises a door that covers the open end of the pocket when the fixed and lockable ends of the gate are stored in the hollow interior of the pocket.

9. An apparatus comprising:

a first gondola fixture including at least two base ends, at least one base deck supported by the at least two base ends, at least two upright frame members extending from the at least one base deck and at least one upright panel located between the at least two upright frame members;

a first cavity member including a first side mounted to one of the at least two base ends of the first gondola fixture, a second side and an open end;

a first gondola end fixture including a base having a back, an end deck supported by the base, two upright frame members extending from the end deck and a back panel located between the two upright frame members, the back of the base of the first gondola end fixture being coupled to the second side of the first cavity member; and a folding door coupled to an interior of the first cavity member, wherein the folding door fits entirely in the first cavity member when the folding door is in a storage state and the folding door at least partially extends out through the open end in the first cavity member when in a use state.

10. The apparatus of claim 9, further comprising:

a second gondola fixture including at least two base ends, at least one base deck supported by the at least two base ends of the second gondola fixture, at least two upright frame members extending from the base deck of the second gondola fixture and at least one upright panel located between the at least two upright frame members of the second gondola fixture;

a second cavity member having a first side and a second side, the first side of the insert being mounted to one of the at least two base ends of the second gondola fixture; and a second gondola end fixture including a base having a back, an end deck supported by the base of the second gondola end fixture, two upright frame members extending from the end deck of the second gondola end fixture, a back panel located between the two upright frame members of the second gondola end fixture, the back of the base being coupled to the second side of the second cavity member; and wherein the second gondola fixture, the second cavity member and the second gondola end fixture are spaced apart from the first gondola fixture, the first cavity member and the first gondola end fixture to define an aisle.

11. The apparatus of claim 10, wherein when the folding door at least partially extends through the open end in the first cavity member in the use state the folding door extends across the aisle and is fixed to an exterior of the second cavity member.

12. The apparatus of claim 10, further comprising at least one transom that is attached to tops of the first and second cavity members and extends across the aisle.

13. The apparatus of claim 12, wherein the at least one transom further comprises a track so that the folding door slidably couples to the at least one transom.

14. The apparatus of claim 9, wherein the first cavity member further comprises a hinged door that covers the open end when the folding door fits entirely in the first cavity member.

15. A method of restricting access to an aisle in a retail store, the method comprising:

moving a gate entirely stored in a pocket, the pocket having a first side mounted to a side of a first retail display unit, a second side mounted to a back of a second retail display unit and an open end so when the gate is moved an end of the gate passes through the open end of the pocket and across an aisle that is defined at least in part by the first retail display unit and the second retail display unit; and locking the end of the gate to close off the aisle.

16. The method of claim 15, further comprising attaching the end of the gate to an exterior of an insert that faces the aisle, wherein a first side of the insert is mounted to a side of a third retail display unit and a second side of the insert is mounted to a back of a fourth retail display unit, the third retail display unit and the fourth retail display unit define an opposing side of a part of the aisle that the first and second retail display units define.

17. The method of claim 16, wherein moving the gate comprises moving the gate along a track located on a bottom of at least one frame member that is coupled to a top of the pocket and extends across the aisle.

18. The method of claim 16, wherein moving the gate comprises moving the gate along a track located on a bottom of at least one transom that is coupled to a top of the pocket and extends across the aisle, the at least one transom having at least one transom window.

19. The method of claim 15, further comprising opening a door that covers the open end of the pocket before moving the gate through the open end and across the aisle.

* * * * *